US009446611B2

(12) United States Patent
Kanekawa et al.

(10) Patent No.: US 9,446,611 B2
(45) Date of Patent: Sep. 20, 2016

(54) IMAGE FORMING APPARATUS CAPABLE OF REDUCING DOWNTIME OF PRINTING WHEN PAPER STORED IN PAPER FEEDING CASSETTE RUN OUT DURING PRINTING

(71) Applicant: KYOCERA Document Solutions Inc., Osaka (JP)

(72) Inventors: Akihiro Kanekawa, Osaka (JP); Naoki Takeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/011,526

(22) Filed: Jan. 30, 2016

(65) Prior Publication Data

US 2016/0221371 A1 Aug. 4, 2016

(30) Foreign Application Priority Data

Jan. 30, 2015 (JP) ..... 2015-016778

(51) Int. Cl.
*B41J 29/393* (2006.01)
*B41J 13/00* (2006.01)

(52) U.S. Cl.
CPC ..... *B41J 13/0009* (2013.01)

(58) Field of Classification Search
CPC B41J 13/0009; B41J 11/0095; B41J 11/009; B41J 13/103; B41J 11/005; B41J 13/0018; B41J 2/04508; B41J 2/07; B41J 2/125; B41J 2/14153; B41J 11/42
See application file for complete search history.

(56) References Cited

U.S. PATENT DOCUMENTS 9,193,192 B1 * 11/2015 Regelsberger ..... B41J 15/16
9,278,559 B1 * 3/2016 Regelsberger ..... B41J 15/16
9,333,775 B2 * 5/2016 Kozuma ..... B65H 23/0326

FOREIGN PATENT DOCUMENTS

JP 2005-145624 A 6/2005

* cited by examiner

*Primary Examiner* — Lamson Nguyen
(74) *Attorney, Agent, or Firm* — Hawaii Patent Services; Nathaniel K. Fedde; Kenton N. Fedde

(57) ABSTRACT

Provided is an image forming apparatus including a plurality of paper feeding cassettes, a paper detecting sensor, a detecting sensor, a paper feeding switching determination part, and a system control part. The paper feeding switching determination part confirms a state change in the paper feeding cassettes, after the elapse of awaiting time until a start of determination of whether or not switching of paper feeding is possible, if it is determined that a document stored in the paper feeding cassettes runs out, based on an operating condition of the apparatus, a change in detection results by the paper feeding detecting sensor, and detection results by the detecting sensor, and determines whether or not the switching of paper feeding is possible. The system control part controls the switching of paper feeding based on the determination results by the paper feeding switching determination part.

6 Claims, 6 Drawing Sheets

IMAGE FORMING APPARATUS CAPABLE OF REDUCING DOWNTIME OF PRINTING WHEN PAPER STORED IN PAPER FEEDING CASSETTE RUN OUT DURING PRINTING

INCORPORATION BY REFERENCE

This application is based on and claims the benefit of priority from Japanese Patent Application No. 2015-016778 filed on Jan. 30, 2015, the entire contents of which are hereby incorporated by reference.

BACKGROUND

The present disclosure relates to an image forming apparatus generating image data by reading a document.

For example, in a typical image forming apparatus that is a MFP (Multifunction Peripheral), such as a printer, a multifunctional printer, and a multifunction machine, it is often the case that an automatic paper feeding mechanism that feeds a paper one by one stored in a paper feeding cassette to a paper conveyance path for guiding the paper to a printing mechanism side.

Further, some of the image forming apparatuses include a cassette detecting sensor that detects a state (open) where a paper feeding cassette is unloaded from an apparatus main body and a state (close) where the paper feeding cassette is loaded into the apparatus main body, and a paper detecting sensor that detects the presence or absence of paper stored in the paper feeding cassette.

Moreover, some of the typical image forming apparatuses include an image forming apparatus having a plurality of paper feeding cassettes so as to be able to switch paper feeding from the other paper feeding cassette when a paper in any of the paper feeding cassettes runs out.

Namely, the typical image forming apparatus is configured to arrange grouped plural sheet storage means in a stacked state, and feed a sheet by switching to the other sheet storage means belonging to the same group when s sheet stored in the sheet storage means during paper feeding runs out.

SUMMARY

A present disclosure provides an image forming apparatus comprising a plurality of paper feeding cassettes that are detachably loaded within an apparatus main body; a paper detecting sensor that detects a paper stored in the paper feeding cassettes; a detecting sensor that detects a paper conveyed along a conveyance path extending from the paper feeding cassettes; a paper feeding switching determination part that performs processing to confirm a state change in the paper feeding cassettes, after the elapse of a waiting time until a start of determination of whether or not switching of paper feeding is possible, when it is determined that the paper stored in the paper feeding cassettes runs out, based on an operating condition of the apparatus, a change in detection results by the paper detecting sensor, and detection results by the detecting sensor, and performs processing to determine whether or not the switching of paper feeding is possible; and a system control part that controls the switching of paper feeding based on determination results by the paper feeding switching determination part.

DETAILED DESCRIPTION

Hereinafter, one exemplary embodiment of an image forming apparatus of the present disclosure will be described with reference to FIG. 1 to FIG. 3. Herein, a MFP (Multifunction Peripheral) that is a multiple peripheral equipment having a multi-operation function for each job, for example, copy, print, and FAX (Facsimile), or the like, is given in the following description as an example of the image forming apparatus.

Figure 1:
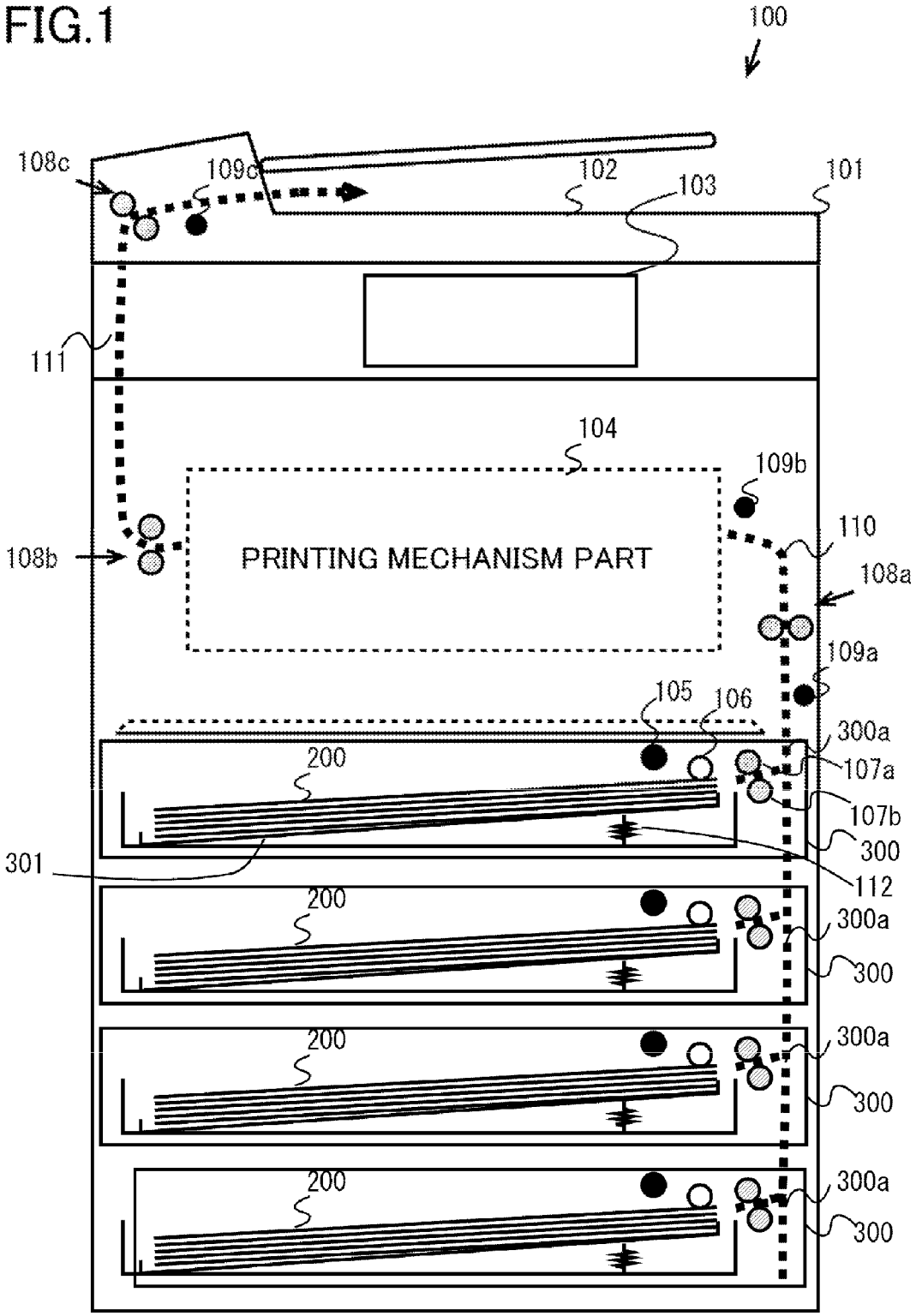
FIG. 1 is a general view showing one embodiment in a case where an image forming apparatus of the present disclosure is taken as a MFP.
Figure 2:
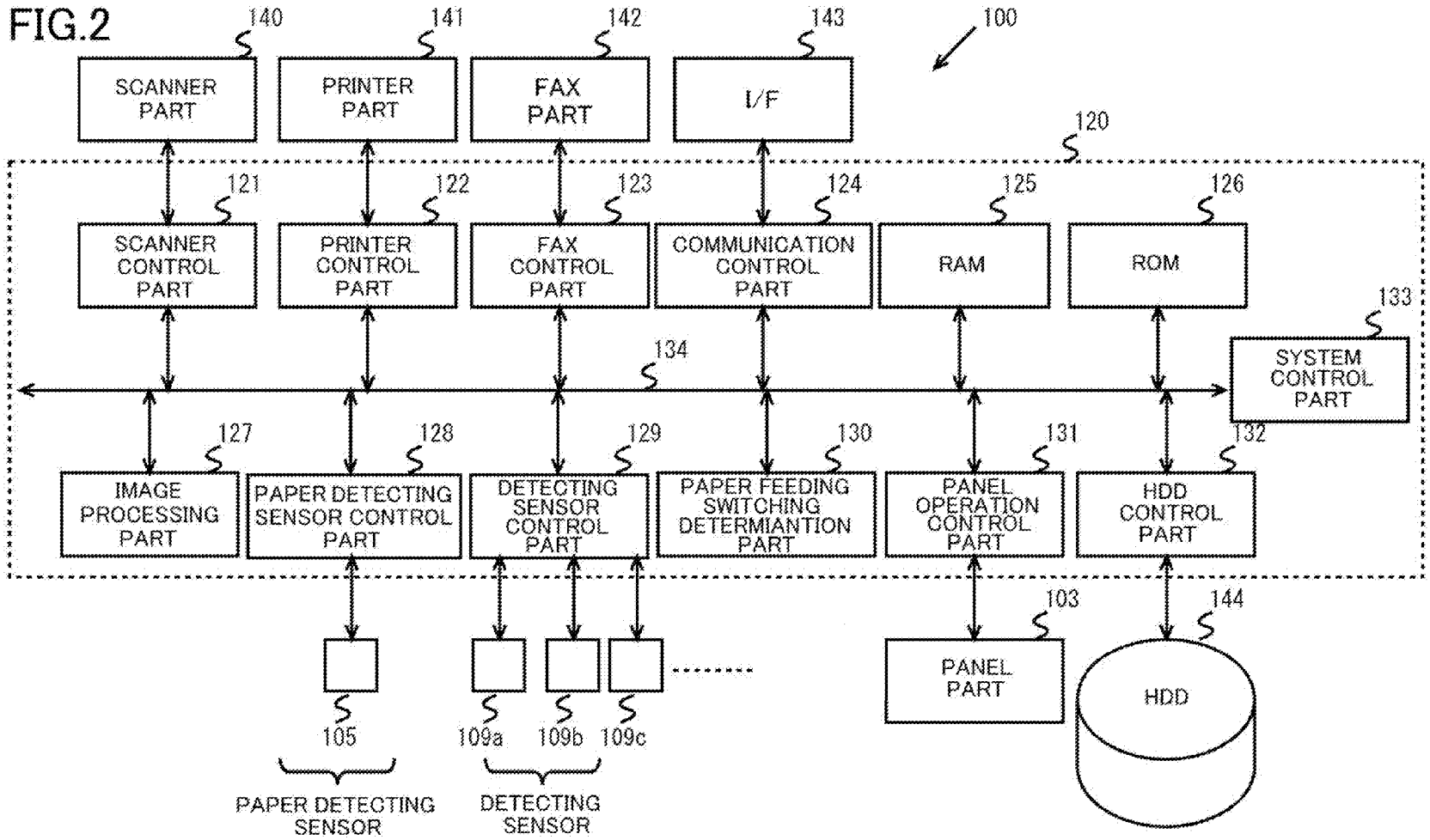
FIG. 2 is a block diagram showing a configuration of the MFP shown in FIG. 1.

First, as shown in FIG. 1, in a MFP 100, there are provided a paper discharging tray 102 on an upper part of a MFP main body 101 and a panel part 103. Further, within the MFP main body 101, there are arranged a printing mechanism part 104 having a photosensitive drum, or the like. Under the printing mechanism part 104, there is arranged in a stacked manner a plurality of paper feeding cassettes 300 that receive a plurality of papers 200. These paper feeding cassettes 300 are configured to be detachable from the MFP main body 101. Further, in each of the paper feeding cassettes 300, there is provided a shared conveyance path 300*a* for the paper 200 to be fed from the paper feeding cassette 300 located at a lower stage.

Further, within the MFP main body 101, there are arranged a paper detecting sensor 105, a feeding roller 106, a driving roller 107*a*, and a driven roller 107*b*. Moreover, within the MFP main body 101, there are provided a paper detecting sensor 105, a feeding roller 106, a driving roller 107*a*, and a driven roller 107*b*. The paper detecting sensor 105, the feeding roller 106, the driving roller 107*a*, and the driven roller 107*b* are arranged correspondingly to a mounting position of each of the paper feeding cassettes 300. In this connection, the paper detecting sensor 105 may be mechanical one or be optical one.

Further, within the MFP main body 101, there are provided a detecting sensor 109*a*, a conveyance roller 108*a*, a detecting sensor 109*b*, conveyance rollers 108*b*, 108*c*, and a detecting sensor 109*c*. The detecting sensor 109*a*, the conveyance roller 108*a*, and the detecting roller 109*b* are arranged along a conveyance path 110 extending from each of the paper feeding cassettes 300 to the printing mechanism part 104. Also, the conveyance rollers 108*b*, 108*c*, and the detecting sensor 109*c* are arranged along a conveyance path 111 extending from the printing mechanism part 104 to the paper discharging tray 102.

In the paper feeding cassette 300, there is provided a lift plate 301 whose one portion opposite to the feeding roller 106 is lifted up by a lift member 112 provided within the MFP main body 101.

When the lift plate 301 is lifted up by the lift member 112, a tip of the paper 200 on the lift plate 301 is pressed against the feeding roller 106. Thereby, the paper 200 stored in the paper feeding cassette 300 is fed out one by one by the feeding roller 106. Further, the paper 200 is detected by the paper detecting sensor 105 in a state where the tip of the paper 200 on the lift plate 301 is being lifted up.

Here, if the paper 200 stored in the paper feeding cassette 300 can be detected, the paper detecting sensor 105 detects the presence of paper. Conversely, if the paper detecting sensor 105 cannot detect the paper 200 stored in the paper feeding cassette 300, the paper detecting sensor 105 detects the absence of paper 200. More specifically, if the paper 200 is not stored in the paper feeding cassette 300, the paper detecting sensor 105 detects the absence of paper. Additionally, if the paper feeding cassette 300 is opened, the paper detecting sensor 105 detects the absence of paper, regardless of whether or not the paper 200 is stored in the paper feeding cassette 300, as the paper detecting sensor 105 cannot detect the paper 200 stored in the paper feeding cassette 300.

The paper 200 fed out from the feeding roller 106 is conveyed by the conveyance roller 108*a* to the printing mechanism part 104 along the conveyance path 110. The paper 200 on which printing is applied by the printing mechanism part 104 is conveyed to the paper discharging tray 102 along the conveyance path 111 by the conveyance rollers 108*b*, 108*c*. When the paper 200 becomes unable to be detected until a specific time elapsed, after the paper 200 is detected by each of the detecting sensors 109*a* to 109*c*, conveyance of the paper 200 is detected by each of the detecting sensors 109*a* to 109*c*. Further, even if the paper 200 is detected by any of the detecting sensors 109*a* to 109*c*, the occurrence of paper jam is assumed at a position where the paper 200 is detected, and the conveyance of the paper 200 is not detected if no change is observed in the detection results (that is, the conveyance of the paper 200 remains detected) even after the specific time has elapsed. Further, if the paper 200 is not detected by any of the detecting sensors 109*a* to 109*c*, it is assumed that the paper 200 is not present in the conveyance path 111, and the conveyance of the paper 200 is not detected. In this connection, the specific time is set to a time longer than that necessary for the paper 20 to pass through each of the detecting sensors 109*a* to 109*c*. Alternatively, the specific time may be a fixed value or be a value different according to a paper size to be conveyed.

As mentioned above, the conveyance paths 110, 111 convey the paper 200 from each of the paper feeding cassettes 300 to the paper discharging tray 102 through the printing mechanism part 104. The conveyance path 110 is provided continuously to the shared conveyance path 300*a* of each of the paper feeding cassettes 300.

In the present exemplary embodiment, though the details will be described later, if a determination can be made that the paper 200 stored in the paper feeding cassette 300 runs out during printing, and the paper feeding cassette 300 is closed (a state where the paper feeding cassette 300 is loaded into the MFP main body 101), paper feeding is switched to the other paper feeding cassette 300.

Next, a description will be made to a configuration of the MFP 100 with reference to FIG. 2. The MFP 100 includes a control part 120, a scanner part 140, a printer part 141, a FAX part 142, an I/F (interface) part 143, the paper detecting sensor 105, the detecting sensors 109*a* to 109*c*, a panel part 103, and a HDD (Hard disk drive) 144.

The scanner part 140 performs processing to input image data of a document to be read by an image sensor to the control part 120. In other words, the scanner part 140 converts an image signal of a document from the image sensor into digital image data, and sequentially inputs the converted digital image data to the control part 120.

The printer part 141 has the printing mechanism part 104 and prints an image on the paper 200 based on the image data output from the control part 120. The FAX part 142 transmits the image data output from the control part 120 to a destination facsimile via a telephone line, receives the image data from the destination facsimile, and inputs the stored image data to the control part 120. In other words, the FAX part 142 compresses and modulates the image data output from the control part 120 while keeping connection with the telephone line through a NCU (Network Control Unit), and transmits the compressed and modulated image data to the destination facsimile. Also, the FAX part 142 demodulates and decompresses the image data from the destination facsimile, and inputs the demodulated and decompressed image data to the control part 120 while keeping connection with the telephone line through the NCU.

The I/F part 143 performs communication, for example, with a client terminal via a network, such as an enterprise LAN (Local Area Network).

As mentioned above, the paper detecting sensor 105 detects the paper 200 stored in the paper feeding cassette 300. As mentioned above, the detecting sensors 109*a* to 109*c* detect the paper 200 to be conveyed along the conveyance paths 110, 111.

The panel part 103 is a circuit, such as an operation panel and a touch panel, that displays an operation button for selecting any of a printer function, a FAX function, and a scan function of the MFP 100, and for performing various settings. The HDD 144 stores an application program, or the like to provide various functions of the MFP 100. Further, the HDD 144 includes a user box, or the like.

The control part 120 is for control of an overall operation of the MFP 100, and includes a scanner control part 121, a printer control part 122, a FAX (Facsimile) control part 123, a communication control part 124, a RAM (Random Access Memory) 125, a ROM (Read Only Memory) 126, an image processing part 127, a paper detecting sensor control part 128, a detecting sensor control part 129, a paper feeding switching determination part 130, a panel operation control part 131, a HDD control part 132, and a system control part 133. These parts are connected to a data bus 134. The scanner control part 121, the printer control part 122, the FAX (Facsimile) control part 123, the communication control part 124, the image processing part 127, the paper detecting sensor control part 128, the detecting sensor control part 129, the paper feeding switching determination part 130, the panel operation control part 131, the HDD control part 132, and the system control part 133 include a processor, such as a Central Processing Unit (CPU), having one or more circuits, being capable of reading various programs to execute them, and executing various programs that have been previously incorporated thereinto. Here, the circuit can be an electronic part in which a plurality of electronic elements are connected by wiring, or an electronic substrate.

The scanner control part 121 controls a reading operation of the scanner part 140. The printer control part 122 controls a printing operation of the printer part 141. The FAX control part 123 controls a transmitting and receiving operation of the image data by the FAX part 142. The communication control part 124 controls communication via the I/F part 143.

The RAM 125 is a work memory to execute a program. The ROM 126 has an area to store a control program to make an operation check for each parts. The image processing part 127 applies image processing to image data of a document read out, for example, by the scanner part 140.

The paper detecting sensor control part 128 controls a paper detecting operation by the paper detecting sensor 105. The detecting sensor control part 129 controls a detecting operation of the paper 200 by the detecting sensors 109*a* to 109*c*.

The paper feeding switching determination part 130 determines whether or not paper feeding switching is possible from an operating condition of the MFP 100, detection results by the paper detecting sensor 105, and detection results by the detecting sensors 109*a* to 190*c*. In this connection, the operating condition of the MFP 100 refers to a condition during printing and a condition during standby. Further, the detection results by the paper detecting sensor 105 refer to detection of a state change from the presence of paper to the absence of paper, or from the absence of paper to the presence of paper. Moreover, the detection results by the detecting sensors 109*a* to 109*c* refer to detection of the paper 200 to be conveyed along the conveyance paths 110, 111.

The paper feeding switching determination part 130 determines first whether or not the MFP 100 is in printing or in standby, each being an operating condition of the MFP 100. Then, when conveyance of the paper 200 in the conveyance paths 110, 111 is detected by the detecting sensors 109*a* to 109*c*, for example, during printing, the paper feeding switching determination part 130 determines that the paper 200 stored in the paper feeding cassette 300 runs out if the detection results by the paper detecting sensor 105 change from the presence of paper to the absence of paper. In this case, the conveyance of the paper 200 in the conveyance paths 110, 111 is detected by the detecting sensors 109*a* to 109*c* during printing. Accordingly, since paper jam does not occur, the paper feeding switching determination part 130 can determine that the paper feeding cassette 300 whose paper 200 in the conveyance paths 110, 111 runs out is closed.

Further, when the conveyance of the paper 200 is not detected by the detecting sensors 109*a* to 109*c*, for example, during printing, the paper feeding switching determination part 130 determines that the paper feeding cassette 300 is opened if the detection results by the paper detecting sensor 105 change from the presence of paper to the absence of paper.

Then, when the paper 200 stored in the paper feeding cassette 300 runs out during printing, the paper feeding switching determination part 130 confirms a state change in the paper feeding cassette 300 (a change from close to open of the paper feeding cassette 300 of the MFP main body 101), after the elapse of a waiting time until a start of determination of whether or not paper feeding switching is possible, to be mentioned later. If no state change is observed in the paper feeding cassette 300, the paper feeding switching determination part 130 determines that switching to paper feeding from the other paper feeding cassette 300 is possible. In this case, if a paper having the same size as the paper 200 during printing, that is, as the paper 200 designated by a user is stored in all the paper feeding cassettes 300, it is determined that the switching of paper feeding is possible, for example, from the paper feeding cassette 300 located at a stage lower than the paper feeding cassette 300 whose paper 200 runs out is possible. Alternatively, if the same paper 200 as the paper designated by a user is stored in the paper feeding cassette 300 located at an stage upper than the paper feeding cassette 300 whose paper 200 runs out, it may be determined that switching to paper feeding from paper feeding cassette 300 located at the upper stage is possible.

Here, a waiting time until a start of determination of whether or not switching of paper feeding by the paper feeding switching determination part 130 is possible can be set arbitrary by an operation through the panel part 103. In other words, if the waiting time until the start of determination of whether or not the switching of paper feeding is possible is set short (for example, 5 sec or so), the paper feeding switching determination part 130 confirms a state change in the paper feeding cassette 300, for example, after 5 sec, from the time when the paper 200 stored in the paper feeding cassette 300 runs out. This enables the paper feeding switching determination part 130 to immediately determine that the switching to paper feeding from the other paper feeding cassette 300 is possible if no state change is observed in the paper feeding cassette 300.

In this case, the paper feeding switching determination part 130 notifies the system control part 133 that the switching to paper feeding from the other paper feeding cassette 300 is possible. Further, the paper feeding switching determination part 130 notifies the system control part 133 that the paper 200 stored in the paper feeding cassette 300 during paper feeding runs out as well.

Meanwhile, if the waiting time until the start of determination of whether or not the switching of paper feeding is possible is set long (for example, 60 sec or so), the paper feeding switching determination part 130 confirms a state change in the paper feeding cassette 300, for example, after 60 sec, from the time when the paper 200 stored in the paper feeding cassette 300 runs out. In other words, the 60 sec is a time set in anticipation of a time required for loading and unloading of the paper feeding cassette 300 used for paper supply from the MFP main body 101. Thus, setting the waiting time long until the start of determination of whether or not the switching of paper feeding is possible allows the paper feeding cassette 300 whose paper 200 runs out to unload from the MFP main body 101, supply the new paper 200, and return the paper feeding cassette 300 back to the MFP main body 101 while the paper feeding switching determination part 130 starts confirmation of a state change in the paper feeding cassette 300.

In this case, since the detection results by the paper detecting sensor 105 change from the absence of paper to the presence of paper, a determination can be made that the paper feeding cassette 300 is closed, thereby enabling continuation of paper feeding from the paper feeding cassette 300 to which the new paper 200 is supplied.

If the state change is observed in the paper feeding cassette 300, after the elapse of the waiting time (for example, 5 sec, 60 sec) until the start of determination of whether or not the switching of paper feeding is possible, the paper feeding switching determination part 130 determines that the switching to paper feeding from the other paper feeding cassette 300 is possible. In this case, since the paper feeding cassette whose paper 200 runs out is opened, the paper feeding switching determination part 130 notifies the system control part 133 that the switching of paper feeding is impossible. However, if the detection results by the paper detecting sensor 105 change from the absence of paper to the presence of paper, the paper feeding switching determination part 130 notifies the system control part 133 that paper feeding is possible. This is because the opened paper feeding cassette 300 is closed.

The waiting time (for example, 5 sec or so, 60 sec) until the start of determination of whether or not the switching of paper feeding is possible can be previously stored, for example, in an internal memory of the paper feeding switching determination part 130. In this connection, a time set to 5 sec or so, for example, means that the time is shorter than a time required for loading and unloading of the paper feeding cassette 300 used for paper supply from the MFP main body 101. In this case, not necessarily limited to the 5 sec, the time may be set to 4 sec or less. Naturally, the time may be set to 0 sec. In this case, the paper feeding switching determination part 130 confirms a state change in the paper feeding cassette 300 concurrently with a time at which the paper 200 runs out. Meanwhile, a time set, for example, to 60 sec or so, means that the time is longer than a time required for loading and unloading of the paper feeding cassette 300 used for paper supply from the MFP main body 101.

Alternatively, the paper feeding switching determination part 130 may change the waiting time until the start of determination of whether or not the switching of paper feeding is possible according to the number of copies. That is, if it is assumed that the number of the paper 200 receivable in the paper feeding cassette 300 is 500 papers, the waiting time until the start of determination of whether or not the switching of paper feeding is possible should be changed to a short time, for example (for example, 5 sec or so) if the number of copies is set to 50% or more, for example (for example, 250 papers or more). This is because there is a high possibility that the paper 200 stored in the paper feeding cassette 300 runs out during paper feeding due to printing, as the number of copies is set to 50% or more, for example (for example, 250 papers or more).

In contrast, if the number of copies is set to several papers, for example, is set to 2% or less (for example, 10 papers or less), a waiting time until a start of determination of whether or not switching of paper feeding is possible should be set long (for example, 60 sec or so). This is because there is a high possibility that the paper feeding cassette 300 whose paper 200 runs out is unloaded from the MFP main body 1 to supply the new paper 200 to the paper feeding cassette 300 not during paper feeding. In this connection, as to confirmation of the number of copies, the paper feeding switching determination part 130 may refer to a counter value, or to a control value of the printer part 141 under the control of the printer control part 122.

As mentioned above, when conveyance of the paper 200 in the conveyance paths 110, 111 is not detected by the detecting sensors 109*a* to 109*c*, for example, during printing, the paper feeding switching determination part 130 determines that the paper feeding cassette 300 is opened if the detection results by the paper detecting sensor 105 change from the presence of paper to the absence of paper. However, the paper feeding switching determination part 130 determines that the switching to paper feeding from the other paper feeding cassette 300 is impossible until the detection results by the paper detecting sensor 105 change from the presence of paper to the absence of paper.

Additionally, if in a case where no paper 200 is stored in all other paper feeding cassettes 300, or in a case where the paper 200 stored in the other paper feeding cassette 300 is different from the paper designated by a user, the paper feeding switching determination part 130 determines that the switching of paper feeding is impossible. However, if no designation is made by a user, for example, it may be determined that the switching of paper feeding from the other paper feeding cassette 300 is possible.

The panel operation control part 131 controls a display operation of the panel part 103. The HDD control part 132 controls reading and writing of data to/from the HDD 144. The system control part 133 mainly controls the switching of paper feeding to the other paper feeding cassette 300 based on the determination results by the paper feeding switching determination part 130. In this connection, timing at which the system control part 133 switches to paper feeding from the other paper feeding cassette 300 can arbitrary be set by an operation through the panel part 103.

Further, if the determination results by the paper feeding switching determination part 130 shows that the switching of paper feeding is impossible, the system control part 133 causes the panel part 103 to display an error display indicating that the switching of paper feeding is impossible through the panel operation control part 131.

Then, a description will be made to a paper switching operation by the MFP 100 with reference to FIG. 3. It is assumed in the following description that the paper 200 having the same size (for example, A4) is stored in each of the paper feeding cassettes 300, for convenience of explanation. Further, it is assumed in the following description that a waiting time until a start of determination determining whether or not the switching of paper feeding by the paper feeding switching determination part 130 is possible is set to 5 sec or so, for example.

First, the paper feeding switching determination part 130 determines whether or not the MFP 100 is in printing (step S101). If it is determined that the MFP 100 is not in printing (step S101: No), the paper feeding switching determination part 130 determines that the MFP 100 is in standby. Otherwise, if it is determined that the MFP 100 is in printing, the paper feeding switching determination part 130 determines by the detecting sensors 109*a* to 109*c* whether or not conveyance of the paper 200 in the conveyance paths 110, 111 is detected (step S103).

If it is determined by the detecting sensors 109*a* to 109*c* that the conveyance of the paper 200 in the conveyance paths 110, 111 is not detected (step S103: No), the paper feeding switching determination part 130 determines whether or not a change is observed in the detection results by the paper detecting sensor 105 corresponding to the paper feeding cassette 300 in use (step S104). If it is determined that no change is observed in the detection results by the paper detecting sensor 105, the paper feeding switching determination part 130 enters a waiting state for determination (step S104: No). Otherwise, if it is determined that the change is observed in the detection results by the paper detecting sensor 105 (step S104: Yes), the paper feeding switching determination part 130 determines that the paper feeding cassette 300 is opened (step S105), and notifies the system control part 133 about that. In this connection, a situation where it is determined in step S103 to be NO includes, for example, a case where paper jam is occurred in the conveyance path 110, or a case where conveyance of the paper 200 is not yet started as a document is under scanning in copy processing.

After step S105, the system control part 133 causes the panel part 103 to display an error display indicating that the switching of paper feeding is impossible through the panel operation control part 131 (step S106).

Otherwise, if it is determined in step S103 that the conveyance of the paper 200 in the conveyance paths 110, 111 is detected by the detecting sensors 109*a* to 109*c* (step S103: Yes), the paper feeding switching determination part 130 determines whether or not a change is observed in the detection results by the paper detecting sensor 105 (step S107). If no change is observed in the detection results by the paper detecting sensor 105, the paper feeding switching determination part 130 enters a standby state (step S107: No). Otherwise, if it is determined that a change is observed in the detection results by the paper detecting sensor 105 (step S107: Yes), the paper feeding switching determination part 130 determines that the paper 200 is not present in the paper feeding cassette 300 (step S108). In this case, as mentioned above, the detection of conveyance of the paper 200 received in the conveyance paths 110, 111 by the detecting sensors 109*a* to 109*c* during printing results in that no paper jam is occurred, thereby determining that the paper feeding cassette 300 whose paper 200 runs out is closed.

Then, the paper feeding switching determination part 130 waits until a waiting time (for example, 5 sec) of whether or not the switching of paper feeding is possible elapsed (step S109: No), and if it is determined that the waiting time has elapsed (step S109: Yes), the paper feeding switching determination part 130 determines whether or not a state change is taken place in the paper feeding cassette 300 (step S110). If it is determined that the state change is observed in the paper feeding cassette 300 at a point of time at which the 5 sec elapsed (step S110: Yes), the paper feeding switching determination part 130 determines that the switching of paper feeding from the other paper feeding cassette 300 is impossible as the paper feeding cassette 300 is opened, and notifies the system control part 133 about that.

In this case, the system control part 133 causes the panel part 103 to display an error message indicating that the switching of paper feeding is impossible through the panel operation control part 131 (step S106).

Otherwise, if it is determined that no state change is observed in the paper feeding cassette 300 at a point of time at which the 5 sec elapsed (step S110: No), the paper feeding switching determination part 130 determines whether or not the switching of paper feeding is possible (step S111).

Here, if in a case where the paper 200 is not present in all the other paper feeding cassettes 300, and a case where the page 200 stored in the other paper feeding cassette 300 is different from the paper designated by a user, the paper feeding switching determination part 130 determines that the switching of paper feeding is impossible (step S111: No), and notifies the system control part 133 about that. In this case, the system control part 133 causes the panel part 103 to display an error display indicating that the switching of paper feeding is impossible through the panel operation control part 131 (step S106).

Otherwise, if it is determined that the paper 200 having the same size as the paper 200 during printing, that is, as the paper 200 designated by a user is stored in the other paper feeding cassette 300, the paper feeding switching determination part 130 determines that the switching of paper feeding from the other paper feeding cassette 300 is possible (step S111: Yes), and notifies the system control part 133 about that.

In this case, the system control part 133 switches to paper feeding from the other paper feeding cassette 300 located, for example, at a lower stage (step S112).

This enables the paper feeding switching determination part 130 to confirm in a short time a state change in the paper feeding cassette 300. If no state change is observed in the paper feeding cassette 300, the paper feeding switching determination part 130 immediately determines that the switching to paper feeding from the other paper feeding cassette 300 is possible. This allows the system control part 133 to quickly switch paper feeding, for example, from the paper feeding cassette 300 located at a lower stage.

Next, a description will be made to an operation in paper feeding switching by the MFP 100 in a case where a waiting time until a start of determination of whether or not switching of paper feeding is possible is set by the paper feeding switching determination part 130 to 60 sec or so, for example.

Figure 3:
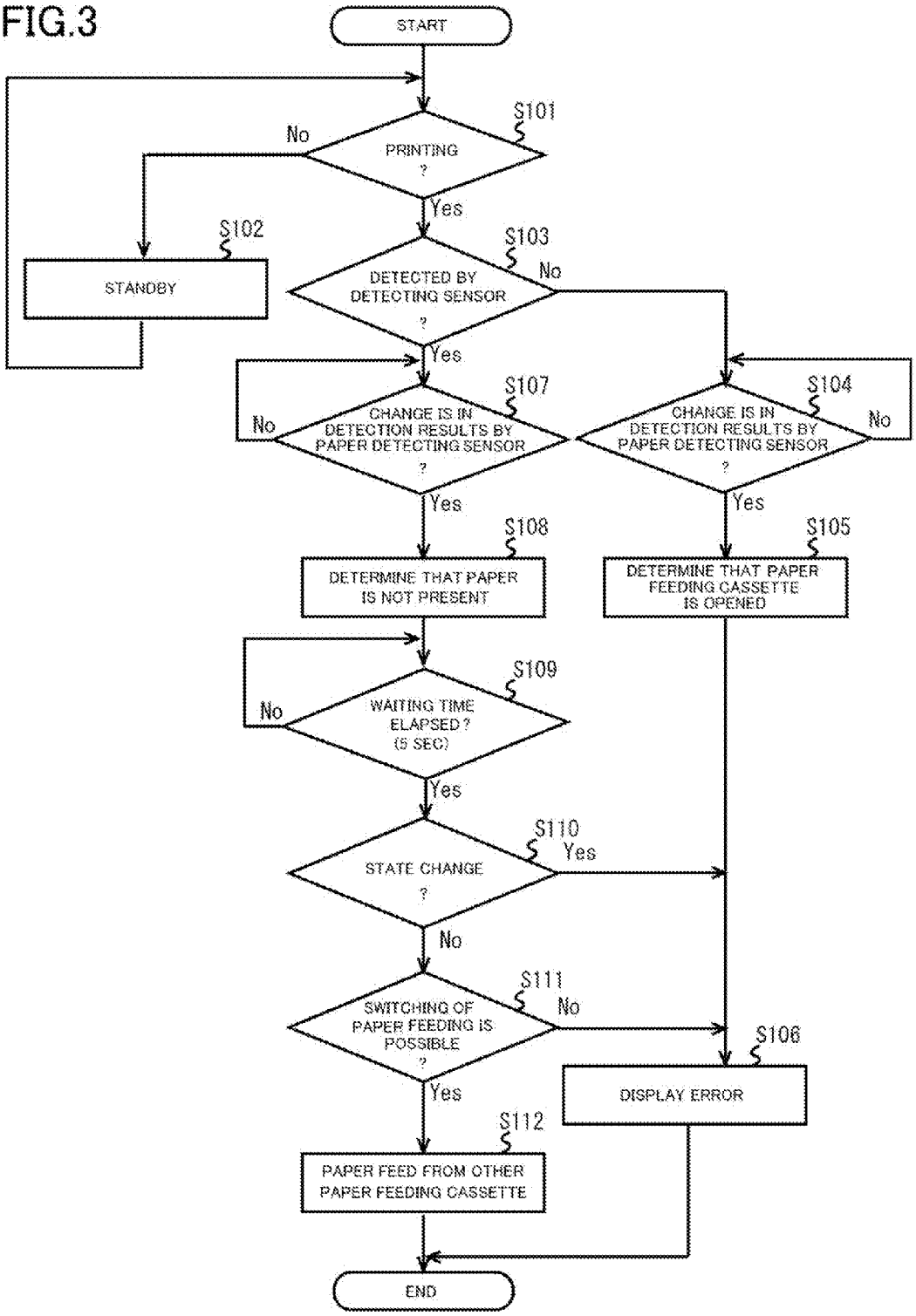
FIG. 3 is a view explaining an operation in paper feeding switching by the MFP shown in FIG. 1, specifically shows an operation in a case where awaiting time until a start of determination of whether or not switching of paper feeding is possible is set to 5 sec or so, for example.

Here, since operations from step S101 to step S108 are the same as those shown in FIG. 3, and therefore a description thereof is omitted for the sake of brevity. The paper feeding switching determination part 130 waits until a waiting time (for example, 60 sec) until a start of determination of whether or not switching of paper feeding is possible (step S109: No). If it is determined that the waiting time has elapsed (step S109: Yes), the paper feeding switching determination part 130 determines whether or not a state change is taken place in the paper feeding cassette 300 (step S110). If it is determined that the state change is observed in the paper feeding cassette 300 at a point of time at which the 60 sec has elapsed (step S110: Yes), the paper feeding switching determination part 130 determines that the switching of paper feeding from the other paper feeding cassette 300 is impossible, as the paper feeding cassette 300 is opened, and notifies the system control part 133 about that.

In this case, the system control part 133 causes the panel part 103 to display an error display indicating that the switching of paper feeding is impossible through the panel operation control part 131 (step S106).

Otherwise, if it is determined that no state change is observed in the paper feeding cassette 300 at a point of time at which the 60 sec has elapsed (step S110: No), the paper feeding switching determination part 130 determines whether or not the switching of paper feeding is possible (step S111).

Here, as mentioned above, if in a case where the paper 200 is not present in all the other paper feeding cassettes 300, or a case where the paper 200 stored in the other paper feeding cassette 300 is different from the paper designated by a user, the paper feeding switching determination part 130 determines that the switching of paper feeding is impossible (step S111: No), and notifies the system control part 133 about that. In this case, the system control part 133 causes the panel part 103 to display an error display indicating that the switching of paper feeding is impossible through the panel operation control part 131 (step S106).

Otherwise, if it is determined that the paper 200 having the same size as the paper 200 during printing, that is, as the paper designated by a user is stored in the other paper feeding cassette 300, the paper feeding switching determination part 130 determines that the switching of paper feeding from the other paper feeding cassette 300 is possible (step S111: Yes), and notifies the system control part 133 about that.

In this case, the system control part 133 switches, for example, to paper feeding from the other paper feeding cassette 300 located at a lower stage (step S112).

Otherwise, if it is determined in step S109 that, for example, 60 sec that is a waiting time until a start of the determination whether or not switching of paper feeding is possible has not yet elapsed (step S109: No), the paper feeding switching determination part 130 determines that a change is observed in the detection results by the paper detecting sensor 105 (step S113). If no change is observed in the detection results by the paper detecting sensor 105, the process returns back to step S109.

Otherwise, if it is determined that the change is taken place in the detection results by the paper detecting sensor 105 (step S113: Yes), the paper feeding switching determination part 130 notifies the system control part 133 that paper feeding from the paper feeding cassette 300 to which the new paper 200 is supplied is possible. This enables the system control part 133 to continue paper feeding from the paper feeding cassette 300 to which the new paper 200 is supplied (step S114).

Namely, that the change is observed in step S113 in the detection results by the paper detecting sensor 105 means that the detection results by the paper detecting sensor 105 are changed from the absence of paper to the presence of paper, and that the paper feeding cassette 300 to which the new paper 200 is supplied is retuned back to the MFP main body 101.

Then, a description will be made to an operation in paper feeding switching by the MFP 100 if a waiting time until a start of determination of whether or not switching of paper feeding is possible is changed according to the number of copies. In this connection, a description will be made in the following description, taking a case, as an example, where the number of copies is set to 50% or more, for example (for example, 250 papers or more).

Here, operations from step S101 to step S108 are the same as those shown in FIG. 3, and therefore a description thereof is omitted for the sake of brevity. The paper feeding switching determination part 130 confirms that the number of copies is set to 50% or more, for example (for example, 250 papers or more). Alternatively, as mentioned above, as to the confirmation of the number of copies, the paper feeding switching determination part 130 may refer to a counter value, or to a control value of the printer part 141 under the control of the printer control part 122.

If it is determined that the number of copies is set to 50% or more, for example (for example, 250 papers or more), the paper feeding switching determination part 130 changes a waiting time until a start of determination of whether or not switching of paper feeding is possible to a short time (for example, 5 sec or so) (step S109).

Then, the paper feeding switching determination part 130 waits until the waiting time (for example, 5 sec) until the start of determination of whether or not the switching of paper feeding is possible (step S110: Yes), and if it is determined that the waiting time has elapsed (step S110: Yes), the paper feeding switching determination part 130 determines whether or not a state change is observed in the paper feeding cassette 300 (step S111). If it is determined that the state change is observed in the paper feeding cassette 300 at a point of time at which the 5 sec has elapsed (step s111: Yes), the paper feeding switching determination part 300 determines that the switching of paper feeding from the other paper feeding cassette 300 is impossible, and notifies the system control part 133 about that. Then, the system control part 133 causes the panel part 103 to display an error display indicating that the switching of paper feeding is impossible through the panel operation control part 131 (step S106).

Otherwise, if it is determined that no state change is observed in the paper feeding cassette 300 at a point of time at which the 5 sec has elapsed (step S111: No), the paper feeding switching determination part 130 determines whether or not the switching of paper feeding is possible (step S112). Here, as mentioned above, if it is determined that the switching of paper feeding is impossible (step S112: No), the paper feeding switching determination part 130 notifies the system control part 133 about that.

Otherwise, if it is determined that the switching of paper feeding is possible (step S112: Yes), the paper feeding switching determination part 130 notifies the system control part 133 about that. In this case, the system control part 133 switches, for example, to paper feeding from the paper feeding cassette 300 located at a lower stage (step S113).

Next, a description will be made to an operation in paper feeding switching by the MFP 100 in a case where the number of copies is set to 2% or less, for example (for example, 10 papers or less).

Figure 4:
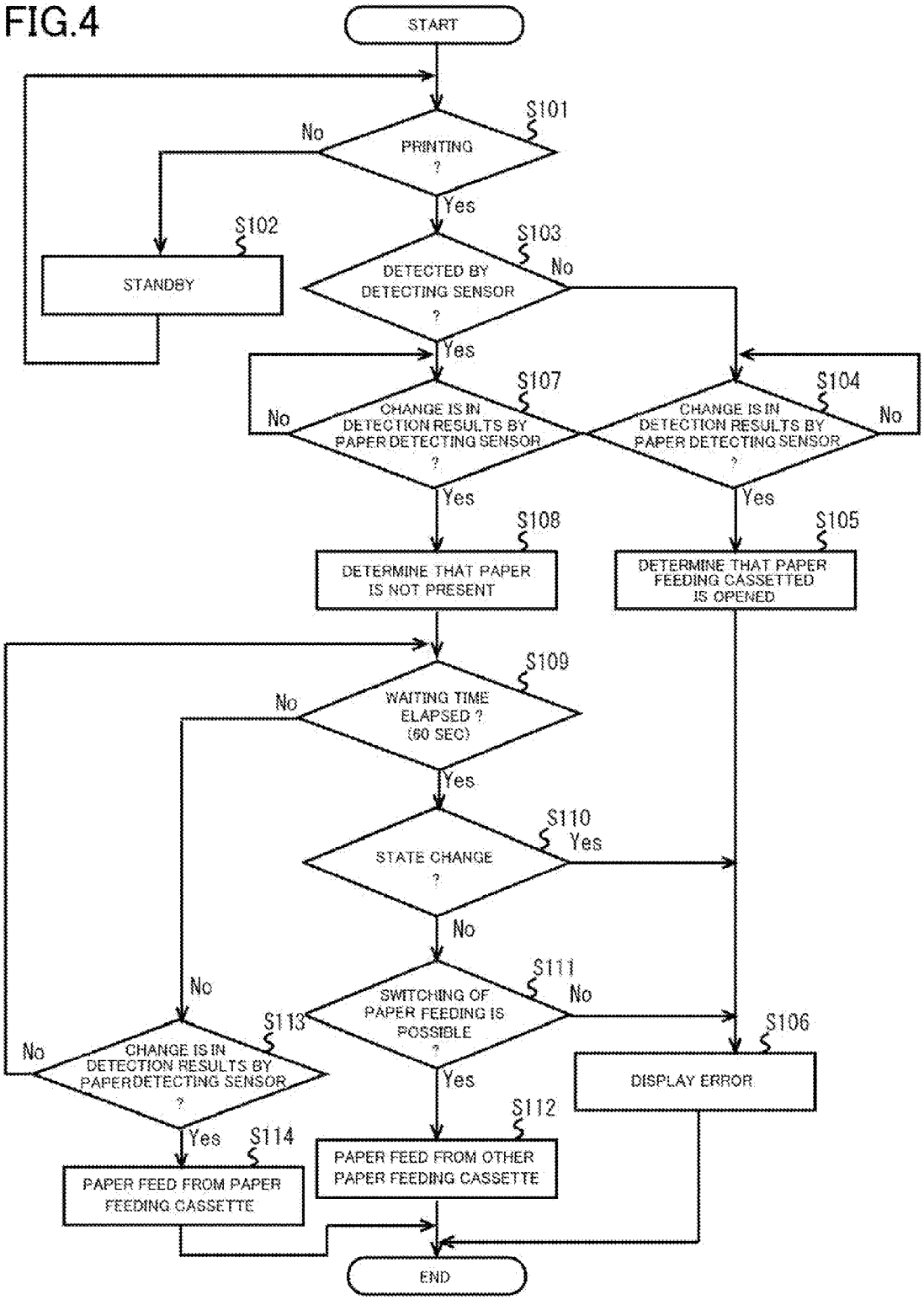
FIG. 4 is a view explaining an operation in paper feeding switching by the MFP shown in FIG. 1, specifically shows an operation in a case where awaiting time until a start of determination of whether or not switching of paper feeding is possible is set to 60 sec or so, for example.
Figure 5:
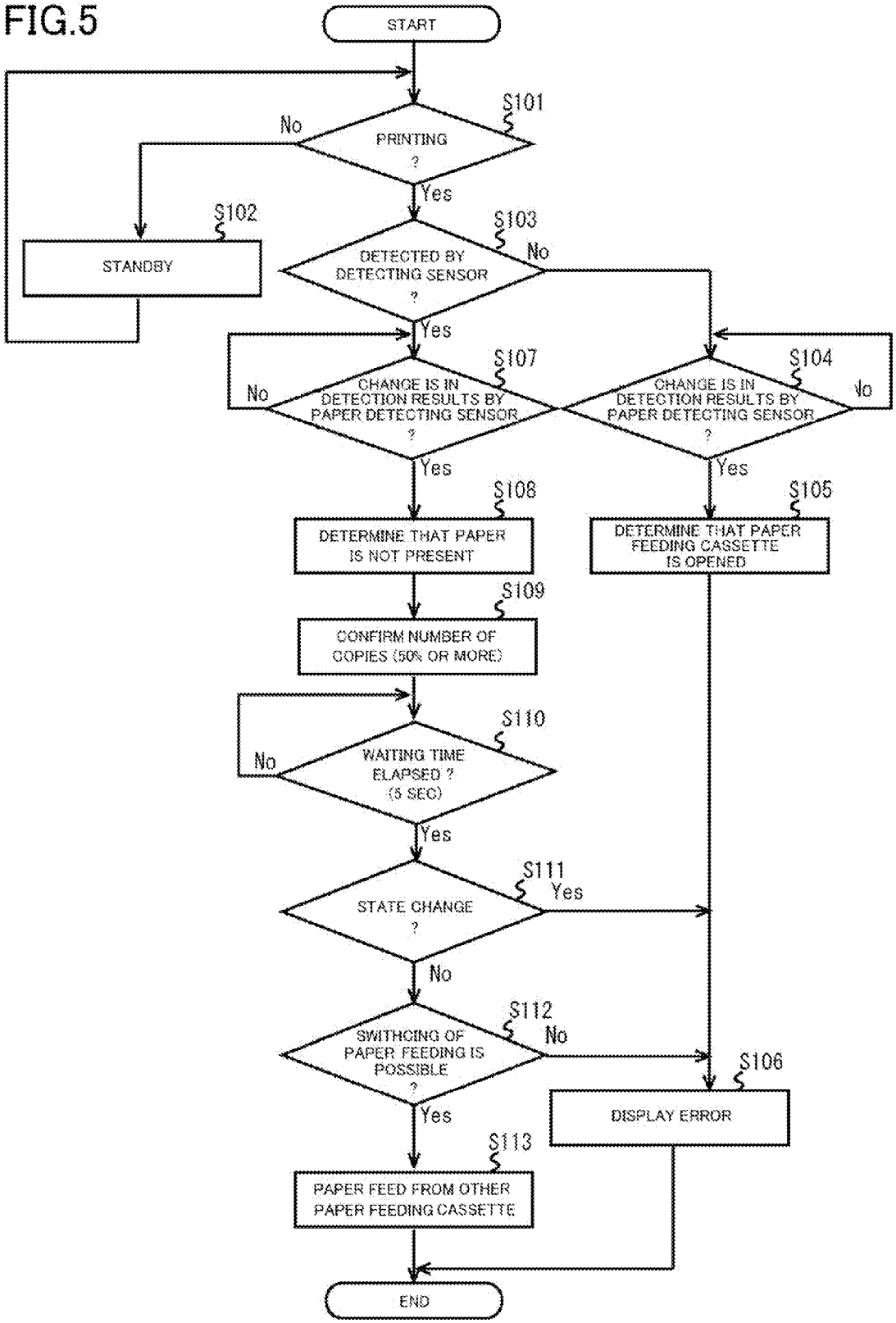
FIG. 5 is a view explaining an operation in paper feeding switching according to the number of copies by the MFP shown in FIG. 1, specifically shows an operation in a case where awaiting time until a start of determination of whether or not switching of paper feeding is possible is set to 5 sec or so, for example.
Figure 6:
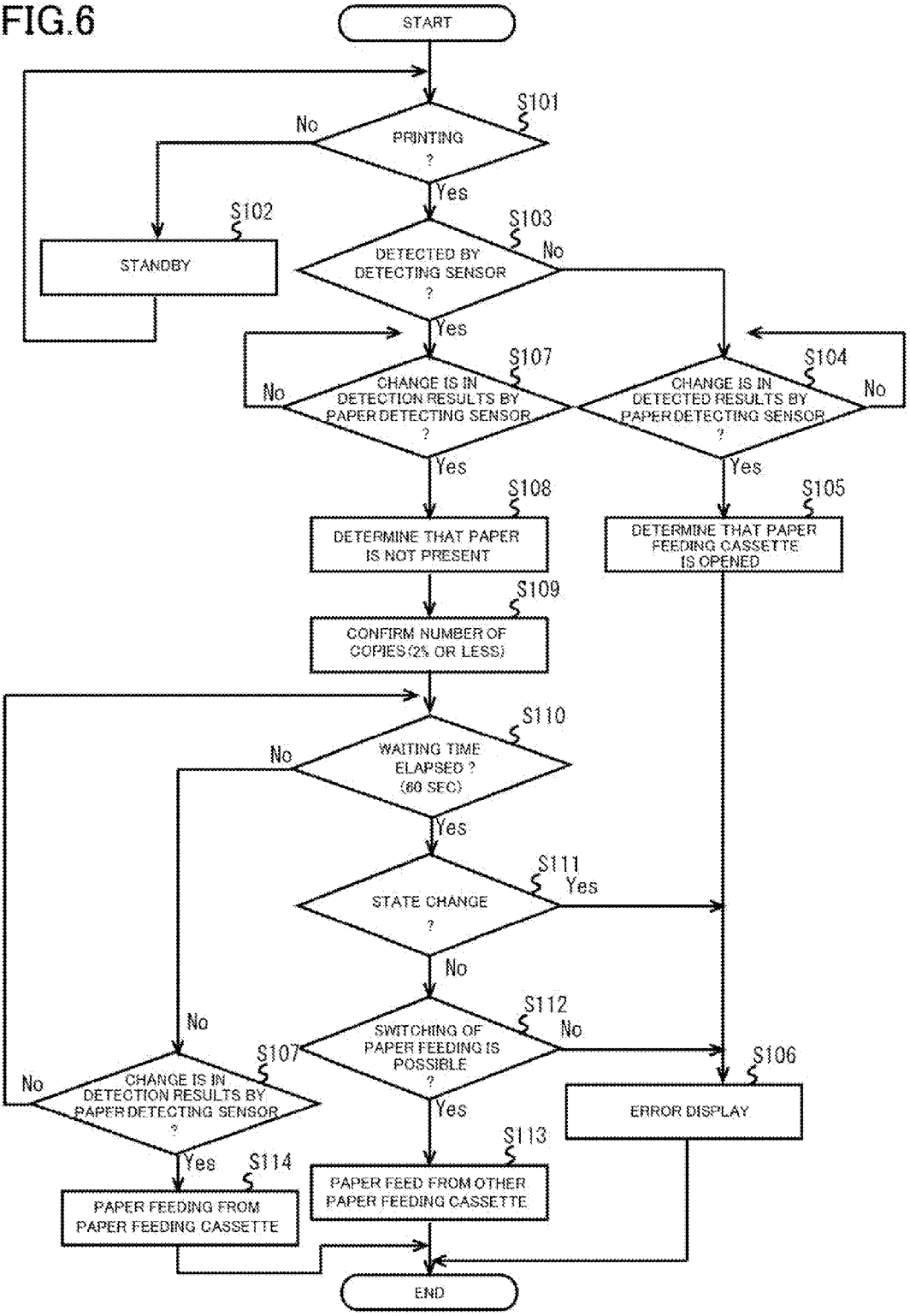
FIG. 6 is a view explaining an operation in paper feeding switching according to the number of copies by the MFP shown in FIG. 1, specifically shows an operation in a case where a waiting time until a start of determination of whether or not switching of paper feeding is possible is set to 60 sec or so, for example.

Here, operations from step S101 to step S108 are the same as those shown in FIG. 4, and therefore a description thereof is omitted for the sake of brevity. Then, if it is confirmed that the number of copies is 20% or less, for example (for example, 10 papers or less), the paper feeding switching determination part 130 changes a waiting time until a start of determination of whether or not switching of paper feeding is possible to a long time (for example, 60 sec or so) (step S109).

Then, the paper feeding switching determination part 130 waits until the waiting time (for example, 60 sec) until the start of determination of whether or not the switching of paper feeding is possible elapsed (step S110: No), determines whether or not if it is determined that the waiting time has elapsed (step S110: Yes), and determines whether or not a state change is taken place in the paper feeding cassette 300 (step S111). If it is determined that the state change is observed in the paper feeding cassette 300 at a point of time at which the 60 sec elapsed (step S111: Yes), the paper feeding switching determination part 130 determines that the switching of paper feeding from the other paper feeding cassette 300 is impossible, as the paper feeding cassette 300 is opened, and notifies the system control part 133 about that.

Otherwise, if it is determined that no state change is observed in the paper feeding cassette 300 at a point of time at which the 60 sec elapsed (step S111: No), the paper feeding switching determination part 130 determines whether or not the switching of paper feeding is possible (step S112).

Here, as mentioned above, if it is determined that the switching of paper feeding is impossible (step S112: No), the paper feeding switching determination part 130 notifies the system control part 133 about that. Otherwise, as mentioned above, if it is determined that the switching of paper feeding is possible (step S112: Yes), the paper feeding switching determination part 130 notifies the system control part 133 about that (step S113).

Otherwise, if it is determined in step S110 that the 60 sec has not yet elapsed, for example (step S110: No), the paper feeding switching determination part 130 determines whether or not a change is taken place in the detection results by the paper detecting sensor 105 (step S114). If it is determined by the paper feeding switching determination part 130 that no change is observed in the detection results by the paper detecting sensor 105 (step S114: No), the process of the paper feeding switching determination part 130 returns back to step S110.

Otherwise, if it is determined that a change is observed in the detection results by the paper detecting sensor 105 (step S114: Yes), the paper feeding switching determination part 130 notifies the system control part 133 that paper feeding from the paper feeding cassette 300 to which the new paper 200 is supplied is possible. This enables the system control part 133 to continue paper feeding from the paper feeding cassette 300 to which the new paper 200 is supplied (step S115).

Thus, in the present exemplary embodiment, the paper feeding switching determination part 130 determines whether or not the paper 200 stored in the paper feeding cassette 300 runs out based on an operating state of the MFP 100, the detection results by the paper detecting sensor 105 detecting the paper 200 to be stored in the paper feeding cassette 300, and the detection results by the detecting sensors 109*a* to 109*c* detecting the paper 200 to be conveyed along the conveyance paths 110, 111 extending from the paper feeding cassette 300. If it is determined that the paper 200 runs out, the paper feeding switching determination part 130 confirms whether or not a change is taken place in the paper feeding cassette 300, after the elapse of the waiting time until the start of determination of whether or not the switching of paper feeding is possible. If the switching of paper feeding is possible, the paper feeding switching determination part 130 notifies the system control part 133 that the switching of paper feeding is possible. This enables the system control part 133 to switch paper feeding based on the determination results obtained by determining whether or not the switching of paper feeding by the paper feeding switching determination part is possible. Thus, it allows the switching of paper feeding to be controlled, thereby reducing downtime of printing when the paper 200 stored in the paper feeding cassette 300 runs out during printing.

Namely, if the waiting time until the start of determination of whether or not the switching of paper feeding is possible is shorter than a time (for example, 5 sec or so) required for loading and unloading of the paper feeding cassette 300 used for paper supply from the MFP main body 101, the paper feeding switching determination part 130 confirms a state change in the paper feeding cassette 300 at a point of time at which the short time elapsed. If it is determined that no state change is observed in the paper feeding cassette 300, the paper feeding switching determination part 130 determines that the switching to paper feeding from the other paper feeding cassette 300 is possible. Then, the paper feeding switching determination part 130 notifies the system control part 133 about that, and thus the system control part 133 can immediately switch to paper feeding of the paper 200 from the other paper feeding cassette 300.

Otherwise, if the waiting time until the start of determination of whether or not the switching of paper feeding is possible is longer than a time (for example, 60 sec or so) required for loading and unloading of the paper feeding cassette 300 used for paper supply from the MFP main body 101, the paper feeding switching determination part 130 confirms a state change in the paper feeding cassette 300 at a point of time at which the long time elapsed. If no state change is observed in the paper feeding cassette 300, the detection results by the paper detecting sensor 105 are confirmed. If the detection results change from the absence of paper to the presence of paper, the paper feeding switching determination part 130 notifies the system control part 133 that paper feeding from the paper feeding cassette 300 to which a paper is supplied is possible, and thus the system control part 133 can immediately continue paper feeding from the paper feeding cassette 300 to which the new paper 200 is supplied.

This enables an immediate determination of whether or not the paper feeding cassette is opened or closed when the paper stored in the paper feeding cassette runs out, for example, during printing, thereby becoming possible to determine at what timing paper feeding should be switched to the other paper feeding cassette.

If the number of copies is more than half (for example, 50% or more) of the number of copies receivable in the paper feeding cassette 300, the paper feeding switching determination part 130 changes so that a waiting time until a start of determination of whether or not switching of paper feeding is possible becomes shorter than a time (for example, 5 sec or so) required for loading and unloading of the paper feeding cassette 300 used for paper supply from the MFP main body 101. At a point of time at which the short time elapsed, the paper feeding switching determination part 130 confirms a state change in the paper feeding cassette 300. If no state change is observed in the paper feeding cassette 300, the paper feeding switching determination part 130 determines that the switching to paper feeding from the other paper feeding cassette 300 is possible. Then, the paper feeding switching determination part 130 notifies the system control part 133 that the switching of paper feeding is possible, and thus the system control part 133 can immediately switch to paper feeding of the paper 200 from the other paper feeding cassette 300.

Further, if the number of copies is set to several papers or so, for example, 2% or less (for example, 10 papers or less), the paper feeding switching determination part 130 changes so that the waiting time until the start of determination of whether or not the switching of paper feeding is possible becomes longer (for example, 60 sec or so) than a time required for loading and unloading of the paper feeding cassette 300 used for paper supply from the MFP main body 101. At a point of time at which the long time elapsed, the paper feeding switching determination part 130 confirms a state change in the paper feeding cassette 300. If no state change is observed in the paper feeding cassette 300, the paper feeding switching determination part 130 confirms the detection results by the paper detecting sensor 105. If the detection results change from the absence of paper to the presence of paper, the system control part 133 notifies the system control part 133 that paper feeding from the paper feeding cassette 300 to which a new paper is supplied is possible, and thus the system control part 133 can immediately continue paper feeding from the paper feeding cassette 300 to which the new paper is supplied.

While in the above-mentioned embodiment, the description is made to a case where the MFP 100 is in printing, the processing in step S104 to step S106 may be executed, subsequent to step S103 shown in FIG. 3 to FIG. 6, if the MFP 100 is in standby. In this instance, if no conveyance of the paper 200 is detected by the detecting sensors 109*a* to 109*c* (step S103: No), the paper feeding switching determination part 130 determines that the paper feeding cassette 300 is opened (step S105) if the detection results by the paper detecting sensor 105 change from the presence of paper to the absence of paper (step S104: Yes). At this time, the paper feeding switching determination part 130 may notice, instead thereof, that the paper feeding cassette 300 determined to be opened and the paper feeding cassette 300 located at a stage lower than the opened paper feeding cassette 300 are unavailable.

Alternatively, if the detection results by the paper detecting sensor 105 change subsequently from the absence of paper to the presence of paper, the paper feeding switching determination part 130 may determine that the paper feeding cassette 300 is closed, and notify that the paper feeding cassette 300 determined to be closed and the paper feeding cassette 300 located at a stage lower than the penned paper feeding cassette 300 are unavailable.

What is claimed is:

1. An image forming apparatus comprising:

a plurality of paper feeding cassettes that are detachably loaded within an apparatus main body;

a paper detecting sensor that detects a paper stored in the paper feeding cassettes;

a detecting sensor that detects a paper conveyed along a conveyance path extending from the paper feeding cassettes;

a paper feeding switching determination part that performs processing to confirm a state change in the paper feeding cassettes, after the elapse of a waiting time until a start of determination of whether or not switching of paper feeding is possible, when it is determined that the paper stored in the paper feeding cassettes runs out, based on an operating condition of the apparatus, a change in detection results by the paper detecting sensor, and detection results by the detecting sensor, and performs processing to determine whether or not the switching of paper feeding is possible; and a system control part that performs processing to control the switching of paper feeding based on determination results by the paper feeding switching determination part.

2. The image forming apparatus according to claim 1, wherein the paper feeding switching determination part performs processing to confirm the state change in the paper feeding cassettes, after the elapse of the waiting time, when the waiting time until the start of determination of whether or not the switching of paper feeding is possible is shorter than a specific time, performs processing to determine that the switching of paper feeding from other the paper feeding cassette is possible when no state change is observed in the paper feeding cassettes, and performs processing to notify the system control part that the switching of paper feeding from the other paper feeding cassette is possible.

3. The image forming apparatus according to claim 1, wherein the paper feeding switching determination part performs processing to confirm the state change in the paper feeding cassettes, after the elapse of the waiting time, when the waiting time until the start of determination of whether or not the switching of paper feeding is possible is longer than the specific time, performs processing to confirm the detection results by the paper detecting sensor when no state change is observed in the paper feeding cassettes, and performs processing to notify the system control part that paper feeding from the paper feeding cassette to which a paper is supplied.

4. The image forming apparatus according to claim 1, wherein the paper feeding switching determination part performs processing to change the waiting time until the start of determination of whether or not the switching of paper feeding is possible according to the number of copies.

5. The image forming apparatus according to claim 4, wherein the paper feeding switching determination part performs processing to change the waiting time until the start of determination of whether or not the switching of paper feeding is possible so as to become shorter than the specific time when the number of copies is more than half of the number of paper receivable in the paper feeding cassettes, performs processing to confirm the state change in the paper feeding cassettes, after the elapse of the waiting time, performs processing to determine that switching to paper feeding from other paper feeding cassette is possible when no state change is observed in the paper feeding cassettes, and performs processing to notify the system control part that the switching of paper feeding to the other paper feeding cassette is possible.

6. The image forming apparatus according to claim 4, wherein the paper feeding switching determination part performs processing to change the waiting time until the start of determination of whether or not the switching of paper feeding is possible, so as to become longer than the specific time, when the number of copies is set to several papers or so, performs processing to confirm the detection results by the paper detecting sensor when no change is observed in the paper feeding cassettes, after the elapse of the waiting time, and performs processing to notify the system control part that paper feeding from the other paper feeding cassette to which a paper is supplied when the detection results change from the absence of paper to the presence of paper.

* * * * *